US008276782B2

(12) United States Patent
Liu

(10) Patent No.: US 8,276,782 B2
(45) Date of Patent: Oct. 2, 2012

(54) CUSHIONING STRUCTURE

(75) Inventor: Tsung Han Liu, Taipei (TW)

(73) Assignee: Pegatron Corporation, Taipei (TW)

( * ) Notice: Subject to any disclaimer, the term of this patent is extended or adjusted under 35 U.S.C. 154(b) by 486 days.

(21) Appl. No.: 12/606,556

(22) Filed: Oct. 27, 2009

(65) Prior Publication Data

US 2010/0108702 A1 May 6, 2010

(30) Foreign Application Priority Data

Oct. 30, 2008 (TW) ..... 97141827 A

(51) Int. Cl.
*B65D 1/40* (2006.01)

(52) U.S. Cl. ..... 220/732; 220/632; 220/655; 206/586; 206/453

(58) Field of Classification Search ..... 220/732, 220/632, 648, 655, 656, 640, 639; 206/586, 206/453; 229/191
See application file for complete search history.

(56) References Cited

U.S. PATENT DOCUMENTS

| | | | | |
|---|---|---|---|---|
| 5,755,331 | A * | 5/1998 | Watson | 206/586 |
| 6,092,651 | A * | 7/2000 | Miller | 206/305 |
| RE37,253 | E * | 7/2001 | Moren et al. | 206/586 |
| 6,268,039 | B1 * | 7/2001 | Chou et al. | 428/122 |
| 6,769,547 | B2 * | 8/2004 | Yu | 206/586 |
| 2006/0021902 | A1 * | 2/2006 | Chen | 206/586 |
| 2007/0138041 | A1 * | 6/2007 | Welsh | 206/349 |
| 2007/0227935 | A1 * | 10/2007 | Saito | 206/586 |

FOREIGN PATENT DOCUMENTS

| | | |
|---|---|---|
| CN | 2537666 | 2/2003 |
| CN | 2745878 | 12/2005 |
| TW | M246316 | 10/2004 |

OTHER PUBLICATIONS

English translation of abstract of TW M246316.
Novelty Search Report, Oct. 17, 2008, 4 pages.

* cited by examiner

*Primary Examiner* — Mickey Yu
*Assistant Examiner* — Kareen Rush
(74) *Attorney, Agent, or Firm* — Thomas, Kayden, Horstemeyer & Risley, LLP

(57) ABSTRACT

A cushioning structure includes a main body and two first cushioning elements. The first cushioning elements clip two ends of the main body, respectively, to form a containing space. Each of the first cushioning elements has two symmetrical cushioning portions for sandwiching the main body. Each of the cushioning portions has an inclined plane extending inward from an edge of the main body.

10 Claims, 9 Drawing Sheets

CUSHIONING STRUCTURE

CROSS-REFERENCE TO RELATED APPLICATIONS

This Non-provisional application claims priority under 35 U.S.C. §119(a) on Patent Application No(s). 097141827 filed in Taiwan, Republic of China on Oct. 30, 2008, the entire contents of which are hereby incorporated by reference.

BACKGROUND OF THE INVENTION

1. Field of the Invention

The invention relates to a cushioning structure and, more particularly, to a cushioning structure formed by folding a corrugated cardboard.

2. Description of the Related Art

With the development of science technology, different kinds of electronic devices have become more and more important in ordinary people's daily life. To avoid damaging the electronic devices by impact during transportation, a cushioning structure formed by folding a corrugated cardboard may be used to protect the electronic devices.

FIG. 1A is a schematic diagram showing cooperation of a conventional cushioning structure 1 and an electronic device D. FIG. 1B is an exploded diagram showing one end S1 of the conventional cushioning structure 1. In FIG. 1A and FIG. 1B, the cushioning structure 1 includes a main body 11, two side cushioning elements 12, and two front cushioning elements 13. The side cushioning elements 12 are connected to two ends S1, S2 of the main body 11, respectively. Each of the side cushioning elements 12 has two cushioning portions 121, 122. The front cushioning elements 13 are respectively disposed at the two ends S1, S2 of the main body 11 and abut against the respective side cushioning elements 12. Each of the front cushioning elements 13 has two symmetrical cushioning portions 131, 132 clipping the main body 11, and the respective side cushioning element 12 is located between the respective cushioning portions 131, 132.

Therefore, the cushioning portions 121, 122 of the side cushioning element 12 can absorb an impact force F1 generated when a lateral surface of the electronic device D is impacted, and the cushioning portions 131, 132 of the front cushioning element 13 can be used to absorb an impact force (not shown) generated when a front surface of the electronic device D is impacted (that is, a direction vertical to a paper where FIG. 1A is drawn).

However, when the electronic device D suffers oblique impact, only the main body 11 of the cushioning structure 1 can be used for cushioning, and there are no other cushioning elements for further absorbing an impact force F2. Therefore, the impact force F2 may cause deformation of the main body 11, further to damage the electronic device D.

In addition, FIG. 1C is a top view showing one end S1 of the cushioning structure 1. In FIG. 1C, if a section of a side edge of the electronic device D is a sharp corner, when the electronic device D impacts the cushioning portions 121, 122, a contacting surface of the cushioning portions 121, 122 may be impacted to cause an uneven force on the cushioning portions 121, 122, further to damage the side cushioning element 12, thereby losing the cushioning function.

BRIEF SUMMARY OF THE INVENTION

This invention provides a cushioning structure capable of improving a cushioning effect to improve the prior art.

According to one aspect of the invention, a cushioning structure includes a main body and two first cushioning elements. The first cushioning elements clip two ends of the main body, respectively, to form a containing space. Each of the first cushioning elements has two symmetrical cushioning portions for sandwiching the main body. Each of the cushioning portions has an inclined plane extending inward from an edge of the main body.

In one embodiment of the invention, each of the cushioning portions may include a first folding element having the inclined plane.

In one embodiment of the invention, the first folding element may be triangular or trapezoid.

In one embodiment of the invention, the cushioning portion may further include a second folding element abutting against the first folding element.

In one embodiment of the invention, the second folding element may be triangular, trapezoid, or rectangular.

In one embodiment of the invention, the cushioning structure may further include two second cushioning elements, and each of the second cushioning elements may be disposed between the respective symmetrical cushioning portions.

In one embodiment of the invention, the first cushioning element may have two side cushioning portions vertical to each other.

In one embodiment of the invention, the main body, the first cushioning elements, and the second cushioning elements may be formed by folding corrugated cardboards.

According to the invention, the first cushioning element of the cushioning structure has two symmetrical cushioning portions for sandwiching the main body, and each of the cushioning portions has an inclined plane extending inward from the edge of the main body. Thereby, when the cushioning structure in the invention suffers oblique impact, the cushioning portions can absorb the impact force. Further, the inclined planes of the cushioning portions increase the whole structural strength of the cushioning structure, thus to avoid deformation of the cushioning structure caused by the impact force of the oblique impact.

In addition, according to the cushioning structure in one embodiment of the invention, the two side cushioning portions of the second cushioning element may be vertical to each other. When the electronic device having a side edge with a sharp section impacts the side cushioning portions, no matter where is impacted, a complete plane of the side cushioning portions may be always provided for suffering the force, thus to prevent the uneven force suffered by the side cushioning portions from damaging the cushioning structure.

These and other features, aspects, and advantages of the present invention will become better understood with regard to the following description, appended claims, and accompanying drawings.

DETAILED DESCRIPTION OF THE INVENTION

Figure 1A:
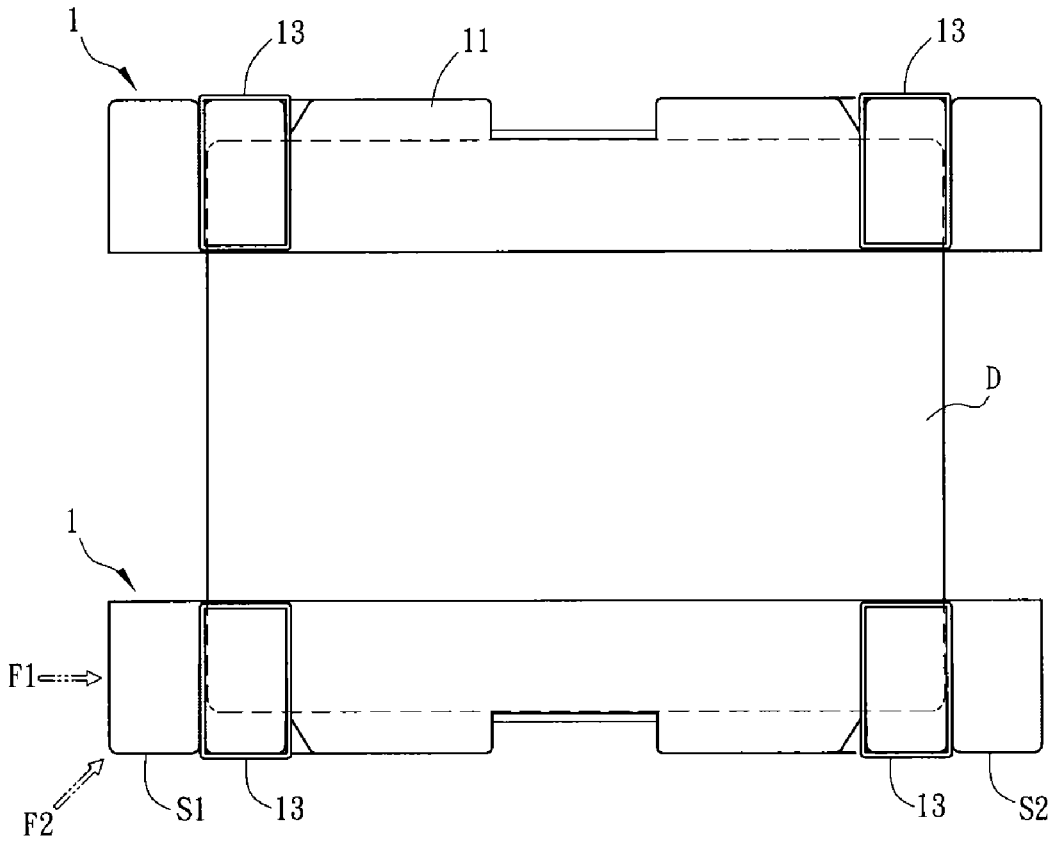
FIG. 1A (Prior Art)
FIG. 1A is a schematic diagram showing cooperation of a conventional cushioning structure and an electronic device.
Figure 1B:
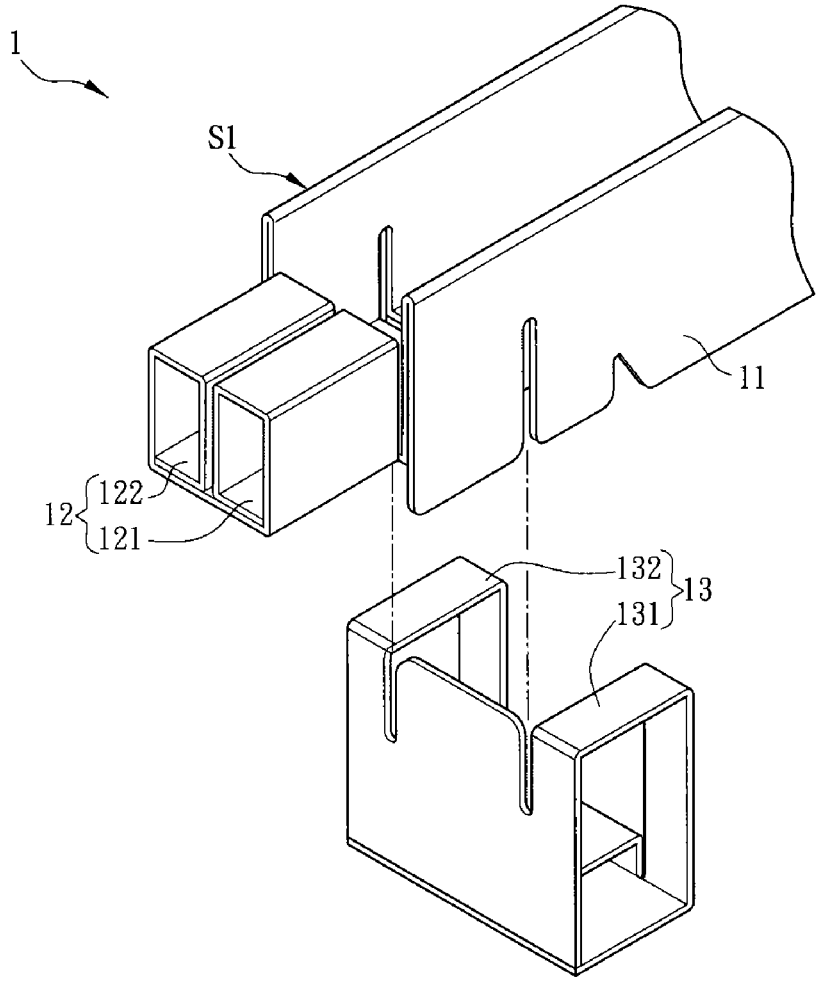
FIG. 1B (Prior Art)
FIG. 1B is an exploded diagram showing one end of the conventional cushioning structure.
Figure 1C:
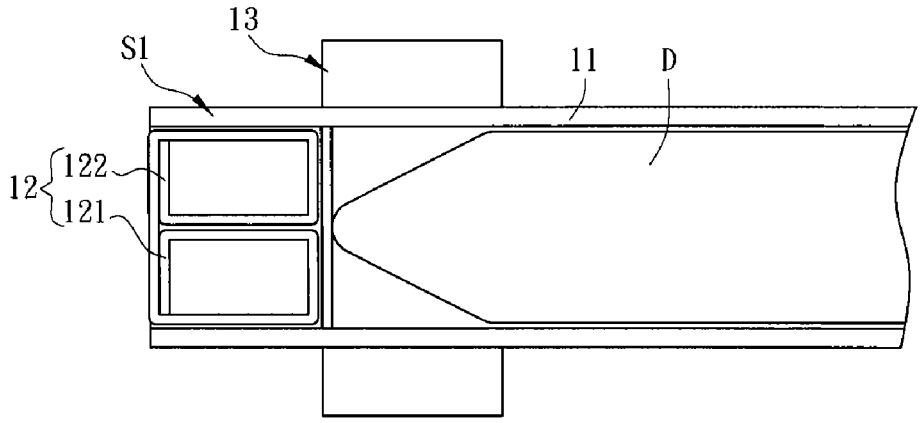
FIG. 1C (Prior Art)
FIG. 1C is a top view showing one end of the conventional cushioning structure.
Figure 2:
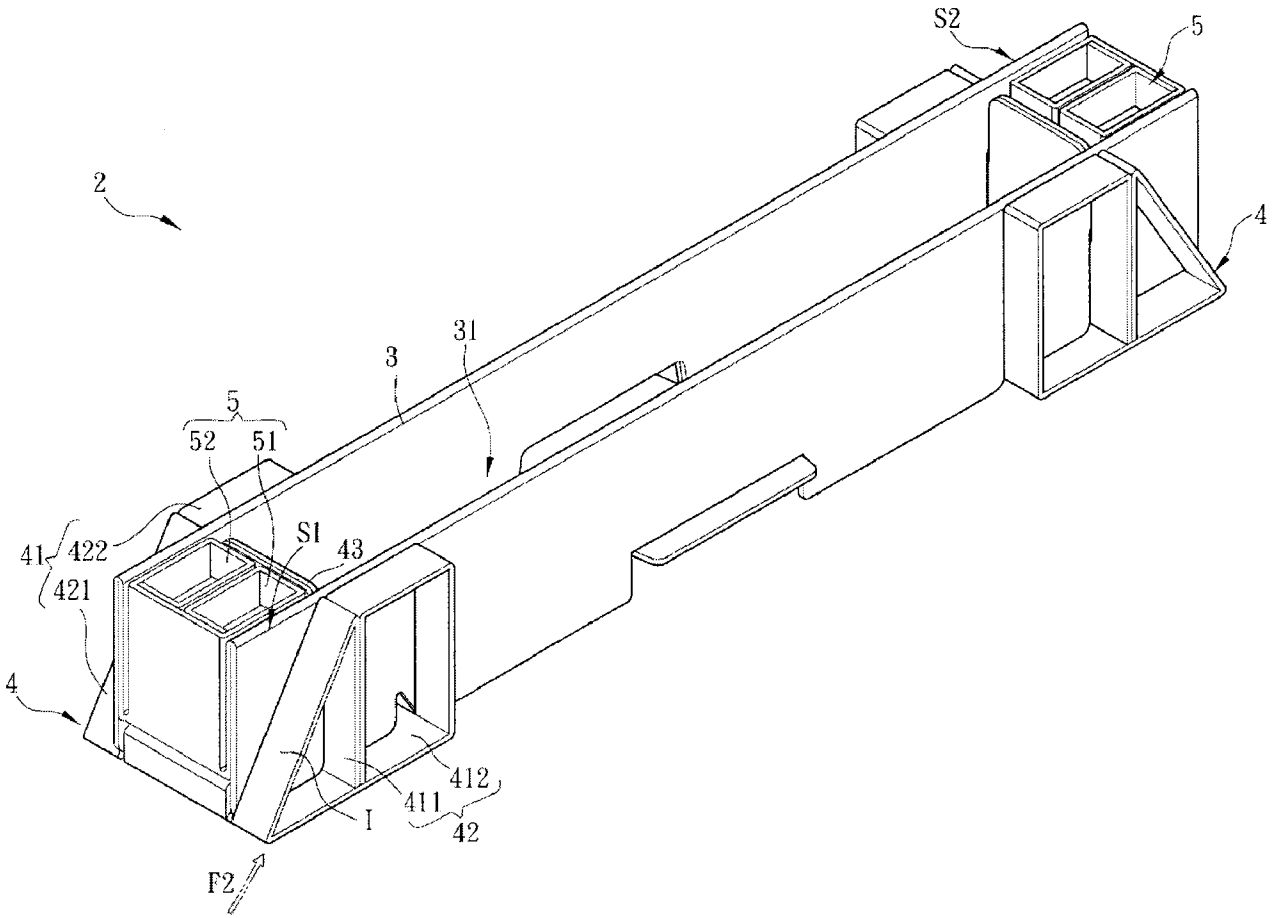
FIG. 2 is a schematic diagram showing a cushioning structure according to one preferred embodiment of the invention.

FIG. 2 is a schematic diagram showing a cushioning structure 2 according to one preferred embodiment of the invention. The cushioning structure 2 includes a main body 3 and two first cushioning elements 4.

The first cushioning elements 4 respectively clip two ends S1, S2 of the main body 3 to form a containing space 31. The first cushioning elements 4 and the main body 3 may be integrally formed or may be formed separately and then assembled. In this embodiment, the first cushioning elements 4 and the main body 3 are formed separately and then assembled. However, the invention is not limited thereto.

Each of the first cushioning elements 4 has two symmetrical cushioning portions 41, 42 for sandwiching the main body 3. Each of the cushioning portions 41, 42 has an inclined plane I, and the inclined plane I extends inward from an edge of the main body 3. The cushioning portions 41, 42 may be triangular or trapezoid. In addition, in this embodiment, the cushioning portion 41 can include a first folding element 411 and a second folding element 412, and the cushioning portion 42 can include a first folding element 421 and a second folding element 422. However, the invention is not limited thereto. The first folding elements 411, 421 have the inclined plane I, respectively, and they may be triangular or trapezoid. The second folding elements 412, 422 abut against the first folding elements 411, 421, respectively, and they may be triangular, trapezoid, or rectangular. In this embodiment, the cushioning portions 41, 42 are trapezoid, and they may include the triangular first folding elements 411, 421 and the rectangular second folding elements 412, 422. However, the invention is not limited thereto.

Further, each of the first cushioning elements 4 can have a retaining element 43 located between the symmetrical cushioning portions 41, 42 to help in forming the containing space 31.

In addition, in this embodiment, the cushioning structure 2 can further include two second cushioning elements 5. Each of the second cushioning elements 5 is disposed between the two symmetrical cushioning portions 41, 42, and each of the second cushioning elements 5 abuts against the respective retaining element 43.

The second cushioning elements 5 and the main body 3 may be integrally formed or be formed separately and then assembled. In this embodiment, the second cushioning elements 5 and the main body 3 are integrally formed. However, the invention is not limited thereto. In addition, in this embodiment, each of the second cushioning elements 5 has two side cushioning portions 51, 52 parallel to each other.

Therefore, when the cushioning structure 2 suffers oblique impact, the cushioning portions 41, 42 can absorb an impact force F2. Further, the inclined planes I of the first folding elements 411, 412 of the cushioning portions 41, 42 increase the whole structural strength of the cushioning structure 2, thus to avoid deformation of the cushioning structure 2 caused by the impact force F2 of the oblique impact.

Figure 3:
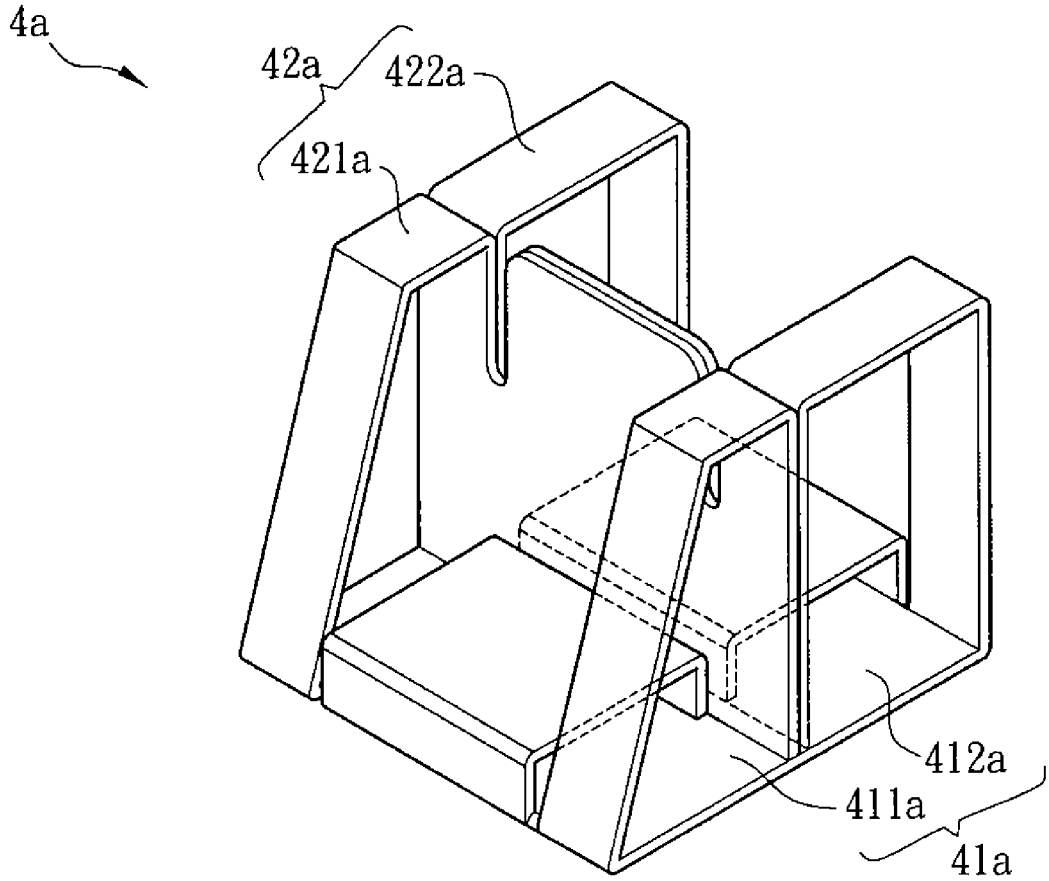
FIG. 3 is a schematic diagram showing a first cushioning element in another form according to one preferred embodiment of the invention.

FIG. 3 is a schematic diagram showing a first cushioning element 4*a* in another form according to one preferred embodiment of the invention. Cushioning portions 41*a*, 42*a* of the first cushioning element 4*a* are trapezoid, and they may include the trapezoid first folding elements 411*a*, 421*a* and the rectangular second folding elements 412*a*, 422*a*. Therefore, the cushioning portions 41*a*, 42*a* may be formed by combining different shapes to satisfy different needs, thus to expand an application range of the cushioning structure in this embodiment.

Figure 4A:
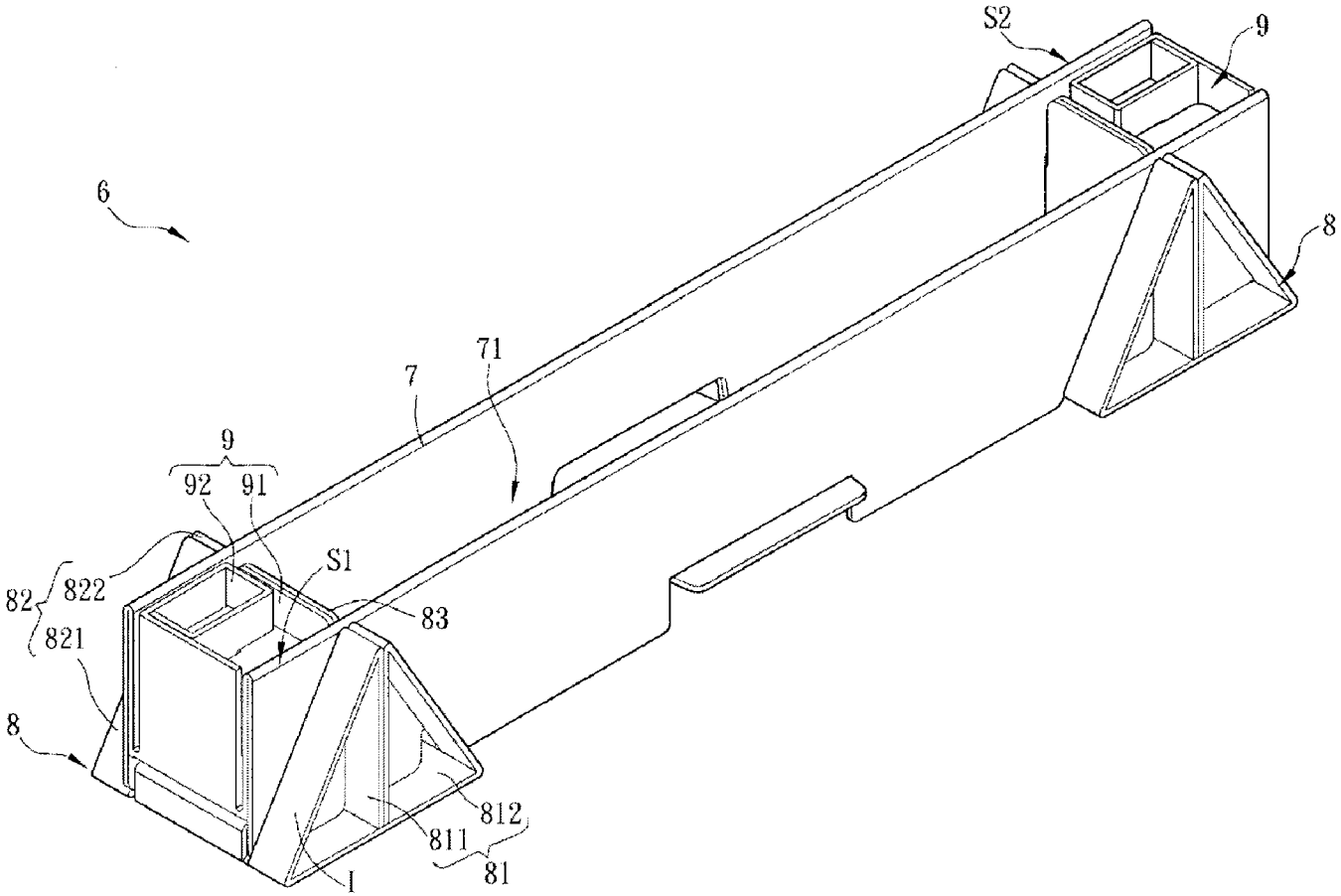
FIG. 4A is a schematic diagram showing a cushioning structure according to another preferred embodiment of the invention.
Figure 4B:
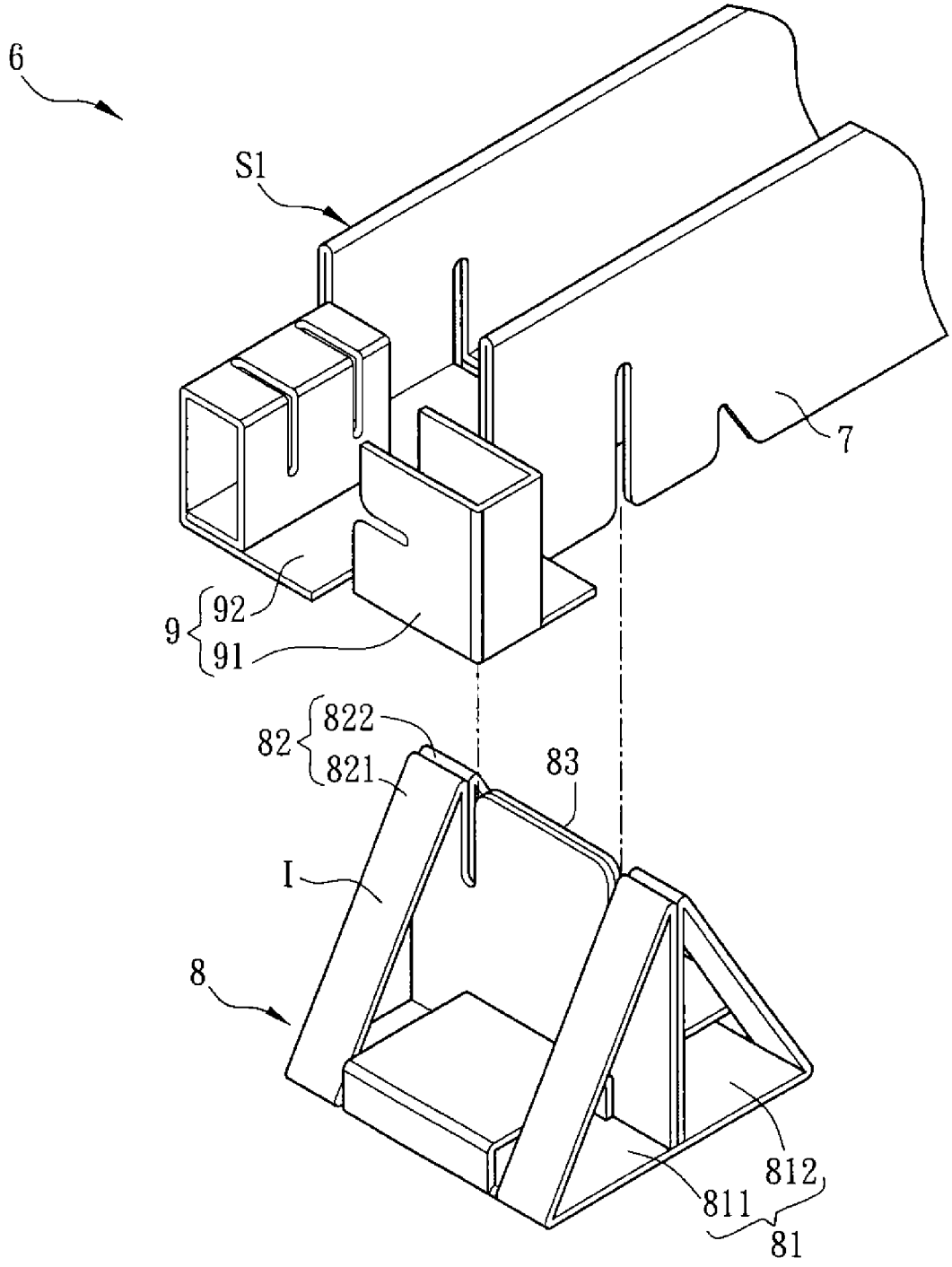
FIG. 4B is an exploded diagram showing one end of the cushioning structure according to another preferred embodiment of the invention.
Figure 4C:
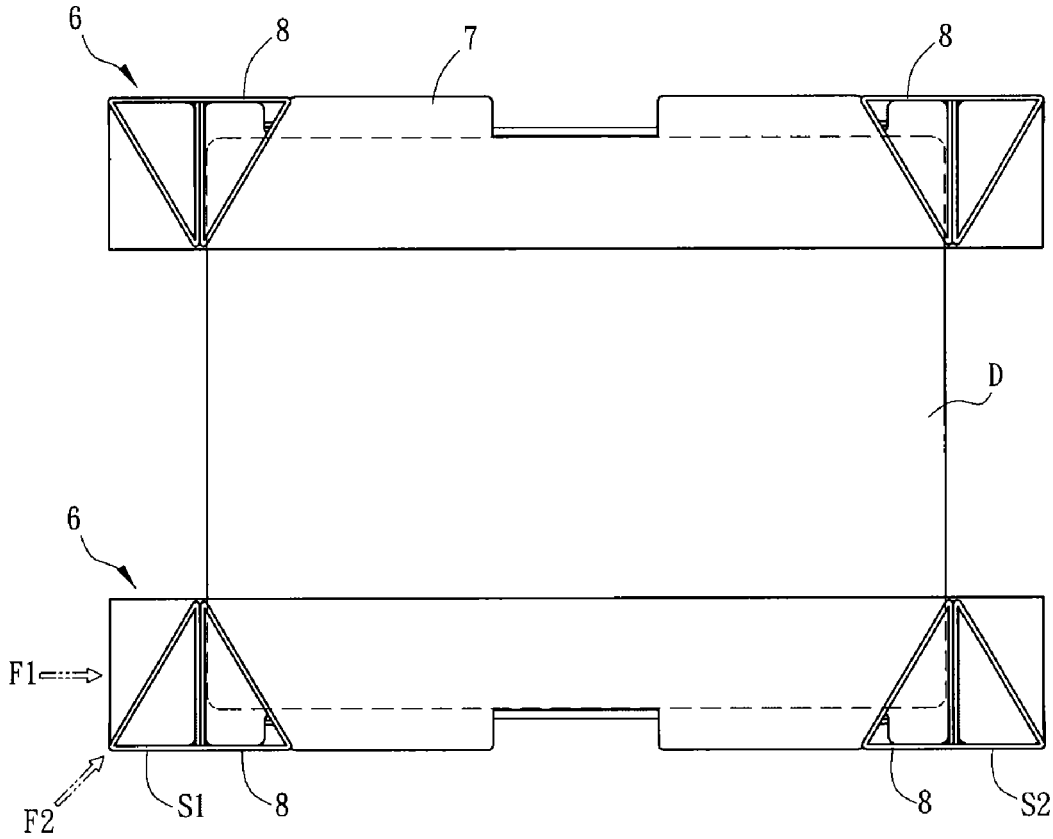
FIG. 4C is a schematic diagram showing cooperation of the cushioning structure and an electronic device according to another preferred embodiment of the invention.

FIG. 4A is a schematic diagram showing a cushioning structure 6 according to another preferred embodiment of the invention. FIG. 4B is an exploded diagram showing one end S1 of the cushioning structure 6. FIG. 4C is a schematic diagram showing cooperation of the cushioning structure 6 and an electronic device D. In FIG. 4A to FIG. 4C, cushioning portions 81, 82 of each first cushioning element 8 of the cushioning structure 6 are triangular, and they may include triangular first folding elements 811, 821 and triangular second folding elements 812, 822. Side cushioning portions 91, 92 of a second cushioning element 9 are vertical to each other. The electronic device D is partly disposed in a containing space 71 of the cushioning structure 6.

Therefore, retaining elements 83 of the first cushioning elements 8 and the second cushioning elements 9 can absorb an impact force F1 generated when lateral surfaces of the electronic device D are impacted. The first cushioning elements 8 can absorb the impact force (not shown) generated when a front surface of the electronic device D is impacted (that is, a direction vertical to a page where FIG. 4C is drawn). Further, when the cushioning structure 6 suffers oblique impact, the cushioning portions 81, 82 can absorb the impact force F2. In addition, the inclined planes I of the first folding elements 811, 821 of the cushioning portions 81, 82, increase the whole structural strength of the cushioning structure 6 thus to avoid deformation of the cushioning structure 6 caused by the impact force F2 of the oblique impact.

In addition, the assembling direction of the first cushioning elements 8 is not limited by the bilateral symmetrical design of the cushioning portions 81, 82, thus to improve assembling efficiency of the cushioning structure 6.

Figure 5:
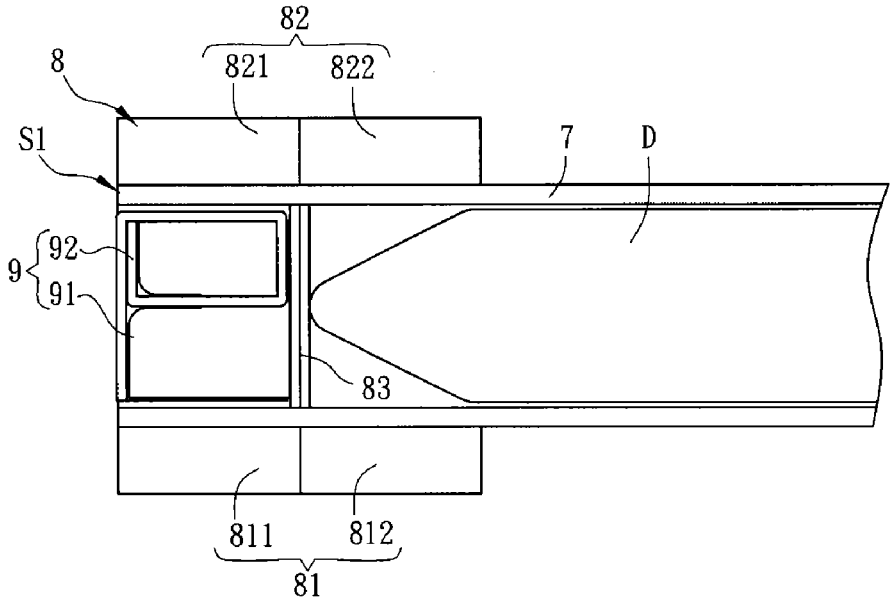
FIG. 5 is a top view showing one end of the cushioning structure according to another preferred embodiment of the invention.

FIG. 5 is a top view showing one end S1 of the cushioning structure 6. If a section of a side edge of the electronic device D is a sharp corner, when the electronic device D impacts the side cushioning portions 91, 92, no matter where is impacted, a complete plane of the side cushioning portions 91 is always provided for suffering the force, thus to prevent the uneven force suffered by the side cushioning portions 91, 92 from damaging the cushioning structure 6.

Figure 6A:
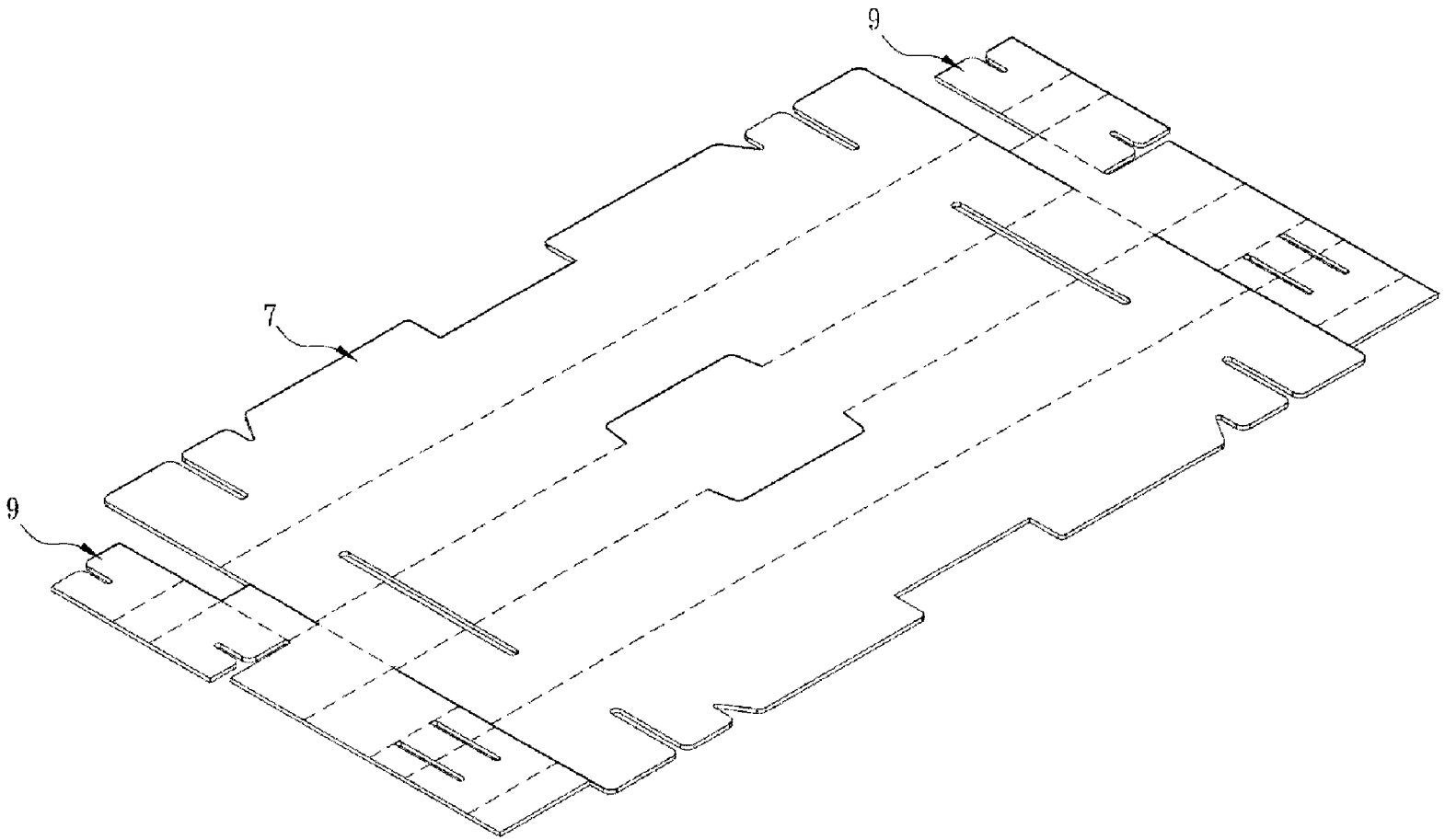
FIG. 6A is an unfolded diagram showing a main body and second cushioning elements of a cushioning structure according to another preferred embodiment of the invention.
Figure 6B:
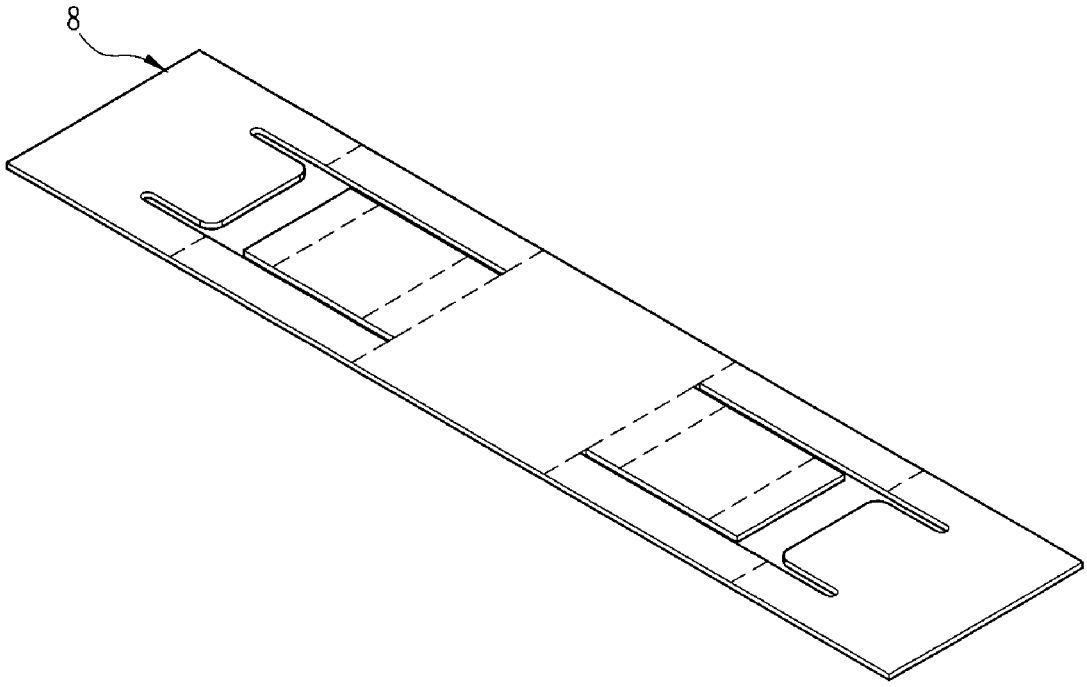
FIG. 6B is an unfolded diagram showing a first cushioning element.

FIG. 6A is an unfolded diagram showing a main body 7 and second cushioning elements 9 of the cushioning structure. FIG. 6B is an unfolded diagram showing a first cushioning element 8 of the cushioning structure. Therefore, according to the cushioning structure in this embodiment, the main body 7, the first cushioning elements 8, and the second cushioning elements 9 can be assembled together after formed by folding corrugated cardboards.

To sum up, according to the embodiments of the invention, the first cushioning element of the cushioning structure has two symmetrical cushioning portions for sandwiching the main body, and each of the cushioning portions has an inclined plane extending inward from the edge of the main body. Thereby, when the cushioning structure in the invention suffers oblique impact, the cushioning portions can absorb the impact force. Further, the inclined planes of the cushioning portions increase the whole structural strength of the cushioning structure, thus to avoid deformation of the cushioning structure caused by the impact force of the oblique impact.

In addition, according to the cushioning structure in one embodiment of the invention, two side cushioning portions of the second cushioning element are vertical to each other. Thereby, when the electronic device having a side edge with a sharp section impacts the side cushioning portions, no matter where is impacted, a complete plane of the side cushioning portion is always provided for suffering the force, thus to prevent the uneven force suffered by the side cushioning portions from damaging the cushioning structure.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A cushioning structure comprising:

a main body; and two first cushioning elements respectively clipping two ends of the main body to form a containing space, each of the first cushioning elements having two symmetrical cushioning portions for sandwiching the main body, each of the cushioning portions having an inclined plane extending inward from an edge of the main body, wherein the inclined plane is externally of the main body for suffering an impact force, and each of the cushioning portions includes a first folding element and a second folding element abutting against and side by side with the first folding element.

2. The cushioning structure according to claim 1, wherein the first folding element has inclined plane.

3. The cushioning structure according to claim 2, wherein the first folding element is triangular or trapezoid.

4. The cushioning structure according to claim 1, wherein the second folding element is triangular, trapezoid, or rectangular.

5. The cushioning structure according to claim 1, wherein the first cushioning elements and the main body are integrally formed.

6. The cushioning structure according to claim 1, further comprising:

two second cushioning elements, each of the second cushioning elements disposed between the respective symmetrical cushioning portions.

7. The cushioning structure according to claim 6, wherein the second cushioning element has two side cushioning portions vertical to each other.

8. The cushioning structure according to claim 6, wherein the second cushioning elements and the main body are integrally formed.

9. The cushioning structure according to claim 6, wherein each of the first cushioning elements has a retaining element between the symmetrical cushioning portions to help in forming the containing space, and each of the second cushioning elements abuts against the respective retaining element.

10. The cushioning structure according to claim 6, wherein the main body, the first cushioning elements, and the second cushioning elements are formed by folding corrugated cardboards.

* * * * *